US006937831B2

(12) United States Patent
Kamimura

(10) Patent No.: US 6,937,831 B2
(45) Date of Patent: Aug. 30, 2005

(54) SEALING SYSTEM FOR A DEVELOPING CARTRIDGE

(75) Inventor: Naoya Kamimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/324,045

(22) Filed: Dec. 20, 2002

(65) Prior Publication Data

US 2003/0118364 A1 Jun. 26, 2003

(30) Foreign Application Priority Data

Dec. 25, 2001 (JP) ..... 2001-391953

(51) Int. Cl.[7] ..... G03G 15/08
(52) U.S. Cl. ..... 399/103
(58) Field of Search ..... 399/103, 105, 399/106, 281

(56) References Cited

U.S. PATENT DOCUMENTS 5,202,729 A * 4/1993 Miyamoto et al. ..... 399/103
6,321,050 B1 * 11/2001 Sato et al. ..... 399/103
6,336,014 B1 1/2002 Sato et al. ..... 399/103
2002/0141777 A1 * 10/2002 Kamimura et al. ..... 399/103
2003/0123899 A1 * 7/2003 Kamimura ..... 399/103

FOREIGN PATENT DOCUMENTS

| | | |
|---|---|---|
| JP | A 10-90998 | 4/1998 |
| JP | A 11-316500 | 11/1999 |
| JP | A 2000-181223 | 6/2000 |
| JP | A 2001-60038 | 3/2001 |

* cited by examiner

*Primary Examiner*—Sandra L. Brase
(74) *Attorney, Agent, or Firm*—Oliff & Berridge, PLC

(57) ABSTRACT

Even with an extend use of a laser printer, toner leakage can be prevented. A side seal disposed at each end of a developing roller includes a sealing member that makes sliding contact with a surface of the developing roller and a sponge seal that supports the sealing member. The sponge seal includes a base portion and a projecting portion. The base portion has a substantially rectangular shape, to which the sealing member is affixed. The projecting portion projects from the center of the base portion toward the inside of the developing roller along its length, without being caught between a supply roller and the developing roller.

25 Claims, 9 Drawing Sheets

SEALING SYSTEM FOR A DEVELOPING CARTRIDGE

BACKGROUND OF THE INVENTION

1. Field of Invention

The invention relates to a developing cartridge which is applied to a laser printer.

2. Description of Related Art

U.S. Pat. No. 6,336,014 discloses a structure where a developing cartridge accommodating toner is detachably attached to a printer. The developing cartridge includes a developing roller that supplies toner to a photosensitive medium and a supply roller that makes contact with the developing roller to supply toner to the developing roller.

The developing cartridge further includes side seals for preventing toner carried on the developing roller from leaking outside from the developing cartridge. The side seals are disposed at both ends of the developing roller with respect to its axial direction so as to make sliding contact with a circumferential surface of the developing roller at the both ends.

The side seals disclosed in U.S. Pat. No. 6,336,014 are made by interposing a polyethylene terephthalate (PET) film between an urethane sponge and a TEFLON® felt, and the surface of the TEFLON® felt makes sliding contact with a circumferential surface of the developing roller.

In the side seals disclosed in U.S. Pat. No. 6,336,014, the PET film is wider than the TEFLON® felt and is caught in between the supply roller and the developing roller. In other words, the PET film can prevent toner in the developing cartridge from directly making contact with the TEFLON® felt.

However, the supply roller is usually made of a sponge. When the PET film makes sliding contact with the circumferential surface of the supply roller, the surface of the supply roller is liable to sustain damage. If a sponge chip of the supply roller gets into the toner, it will deteriorate image quality.

SUMMARY OF THE INVENTION

The invention provides a developing cartridge that can reliably prevent leakage of developer during an extended period of use.

According to one aspect of the invention, a developing cartridge includes a housing that accommodates developer therein; a supply roller, rotatably supported at the housing, that supplies the developer; a developing roller, rotatably supported at the housing, that holds the developer thereon supplied by the supply roller; and a side seal provided at both lengthwise ends of the developing roller. The side seal further includes a sealing element making a sliding contact with a circumferential surface of the developing roller; and a seal member including a base portion that supports the sealing element thereon, and a projecting portion projecting from the base portion toward an opposite end to one lengthwise end of the developing roller.

According to the above structure, the seal member is provided with the projecting portion that projects from the base portion toward an inside of the developing roller along its length. When the sealing element is affixed to the seal member, even if the sealing element deviates from the seal member inwardly, the sealing element is supported by the projecting portion. Thus, direct contact between the developer and the sealing element can be prevented. Therefore, the developer leakage can be reliably prevented even in extended use.

When the supply roller and the projecting portion are disposed such that an end surface of the supply roller makes contact with the projecting portion, the supply roller can reliably supply the developer to the developing roller.

Preferably, the length that the projecting portion projects is in the range of 0.5 to 2.5 mm. In this case, the end of the projecting portion is located outside a range in which an image is formed on a photosensitive medium, and further is outside a range of a maximum width of a recording medium.

By moving the developer making contact with the projecting portion to a space (M) provided between the housing and the supply roller, the developer can be prevented from building up at the projecting portion.

Further, by moving the developer in contact with the projecting portion to a space provided between the projecting portion and a regulating member by rotation of the developing roller, the developer can be prevented from building up at the projecting portion.

The seal member is symmetrical with respect to the center of the developing roller with respect to the rotational direction thereof. Therefore, it can be assembled at either end of the developing roller along its length, thereby reducing the number of parts and costs due to commonality of parts, and simplifying assembly operation.

With the projecting portion and the recess, the seal member can be easily produced by stamping without loss of material. Regarding an end portion, which is on a side of the seal member where the recess is provided, as a positioning mark for attaching the seal member to the housing, parts composition can be simplified and assembly costs can be reduced.

When the seal member is made of an elastic foam material, especially urethane, it resists permanent deflection. Therefore, the seal member and the developing roller are pressed against each other to an appropriate extent, so that leakage of the developer can be prevented even during extended use.

The seal member has a hardness of 0.001 to 0.05 MPa, preferably 0.005 to 0.025 MPa, under 25% compression load.

Leakage of polymerized toner can be reliably prevented even if it is used to obtain high quality images.

The sealing element making a slide contact with the surface of the developing roller is affixed to the seal member. The seal member is curved along a circumferential surface of the developing roller, so that the sealing element is also curved along the circumferential surface of the developing roller. Thereby, the sealing element is more preferably pressed against the circumferential surface of the developing roller, so that leakage of the developer can be reliably prevented.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
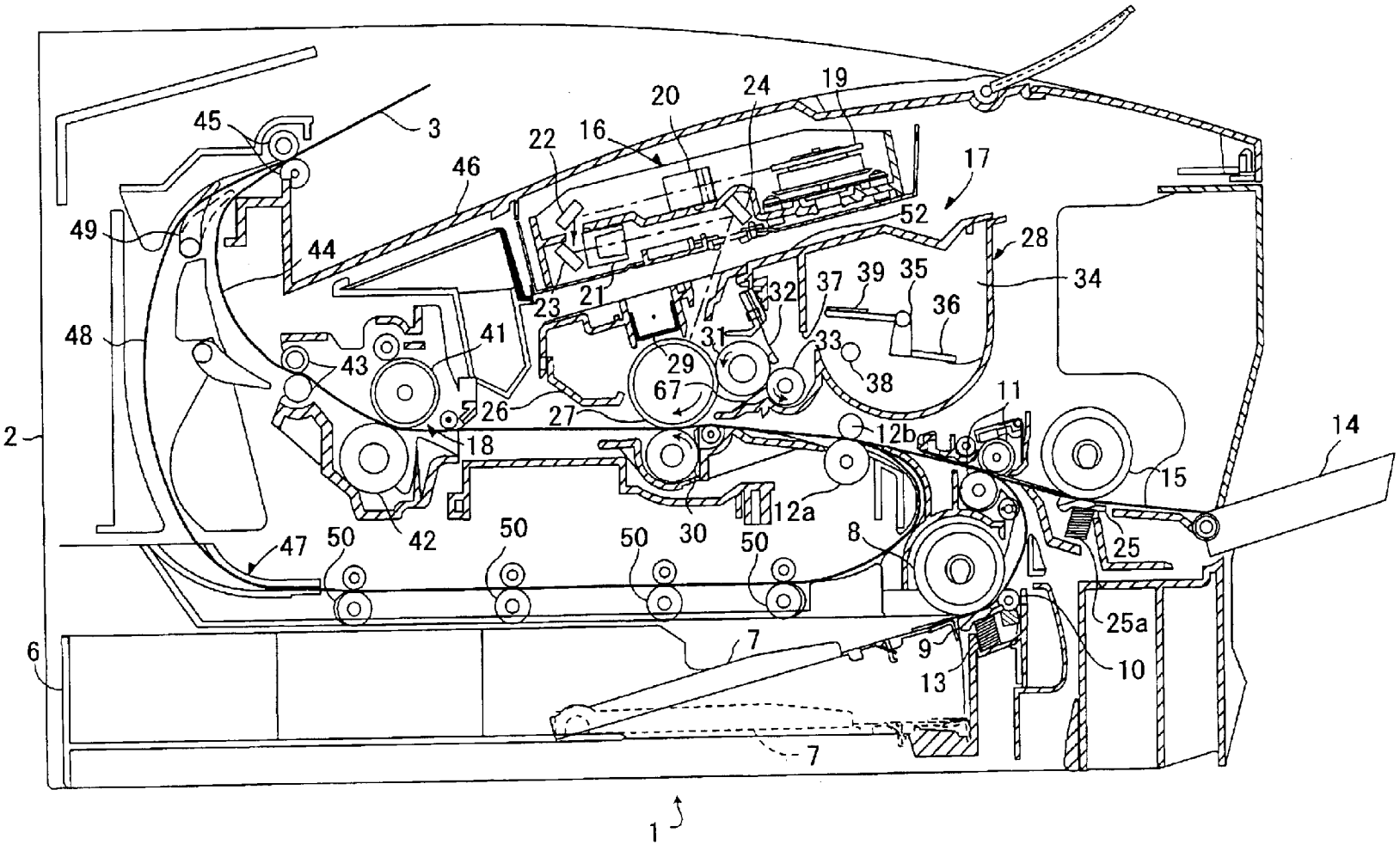
FIG. 1 is a side sectional view of the principal parts of a laser printer according to one embodiment of the invention.

FIG. 1 is a side sectional view of the principal parts of a laser printer 1 according to an embodiment of the invention. A sheet feed tray 6 is detachably attached to a bottom portion of a casing 2. A presser plate 7 is provided in the sheet feed tray 6 to support and upwardly press sheets 3 stacked in the sheet feed tray 6. A sheet feed roller 8 and a sheet feed pad 9 are provided above one end of the sheet feed tray 6, and register rollers 12*a*, 12*b* are provided downstream from the sheet feed roller 8 with respect to the sheet conveying direction.

The presser plate 7 allows sheets 3 to be stacked thereon. The presser plate 7 is pivotally supported at its end remote from the sheet feed roller 8 such that the presser plate 7 is vertically movable at its end closest to the sheet feed roller 8. The presser plate 7 is urged upwardly from its reverse, or bottom, side by a spring (not shown). When the stack of sheets 3 increases in quantity, the presser plate 7 swings downwardly about the end of the presser plate 7 remote from the sheet feed roller 8, against the urging force of the spring. The sheet feed roller 8 and the sheet feed pad 9 are disposed facing each other. The sheet feed pad 9 is urged toward the sheet feed roller 8 by a spring 13 disposed on the reverse side of the sheet feed pad 9.

An uppermost sheet 3 in the stack on the presser plate 7 is pressed against the sheet feed roller 8 by the spring provided on the reverse side of the presser plate 7, and the uppermost sheet 3 is pinched between the sheet feed roller 8 and the sheet feed pad 9 when the sheet feed roller 8 rotates. Thus, the sheets 3 are fed one by one from the top of the stack.

After paper dust is removed from the sheet 3 by a paper dust removing roller 10, the sheet 3 is conveyed by conveyer rollers 11 to the register rollers 12*a*, 12*b*. The register rollers 12*a*, 12*b* comprise a driving roller 12*a* provided in the casing 2 and a driven roller 12*b* provided in a process unit 17, which will be described later. The driving roller 12*a* and the driven roller 12*b* make a surface-to-surface contact with each other. The sheet 3, conveyed by the conveyor rollers 11, is further conveyed downstream while being pinched between the driving roller 12*a* and the driven roller 12*b*.

The driving roller 12*a* is not driven before the sheet 3 makes contact with the driving roller 12*a*. After the sheet 3 makes contact with the driving roller 12*a* and the driving roller 12*a* corrects the orientation of the sheet 3, the driving roller 12*a* rotates and conveys the sheet 3 downstream.

A manual feed tray 14, from which sheets 3 are manually fed, and a manual feed roller 15, that feeds sheets 3 stacked on the manual feed tray 14, are provided at the front of the casing 2. A separation pad 25 is disposed facing the manual feed roller 15. The separation pad 25 is urged toward the manual feed roller 15 by a spring 25*a* disposed on the reverse, or bottom, side of the separation pad 25. The sheets 3 stacked on the manual feed tray 14 are fed one by one while being pinched by the manual feed roller 15 and the separation pad 25 when the manual feed roller 15 rotates.

The casing 2 further holds a scanner unit 16, the process unit 17, and a fixing unit 18. The scanner unit 16 is provided in an upper portion of the casing 2 and has a laser emitting portion (not shown), a rotatable polygonal mirror 19, lenses 20, 21, and reflecting mirrors 22, 23, 24. A laser beam emitted from the laser emitting portion is modulated based on predetermined image data. The laser beam sequentially passes through or reflects from the optical elements, that is, the polygonal mirror 19, the lens 20, the reflecting mirrors 22, 23, the lens 21, and the reflecting mirror 24 in order as indicated by a broken line in FIG. 1. The laser beam is thus directed to and scanned at a high speed over the surface of a photosensitive drum 27, which will be described later.

Figure 2:
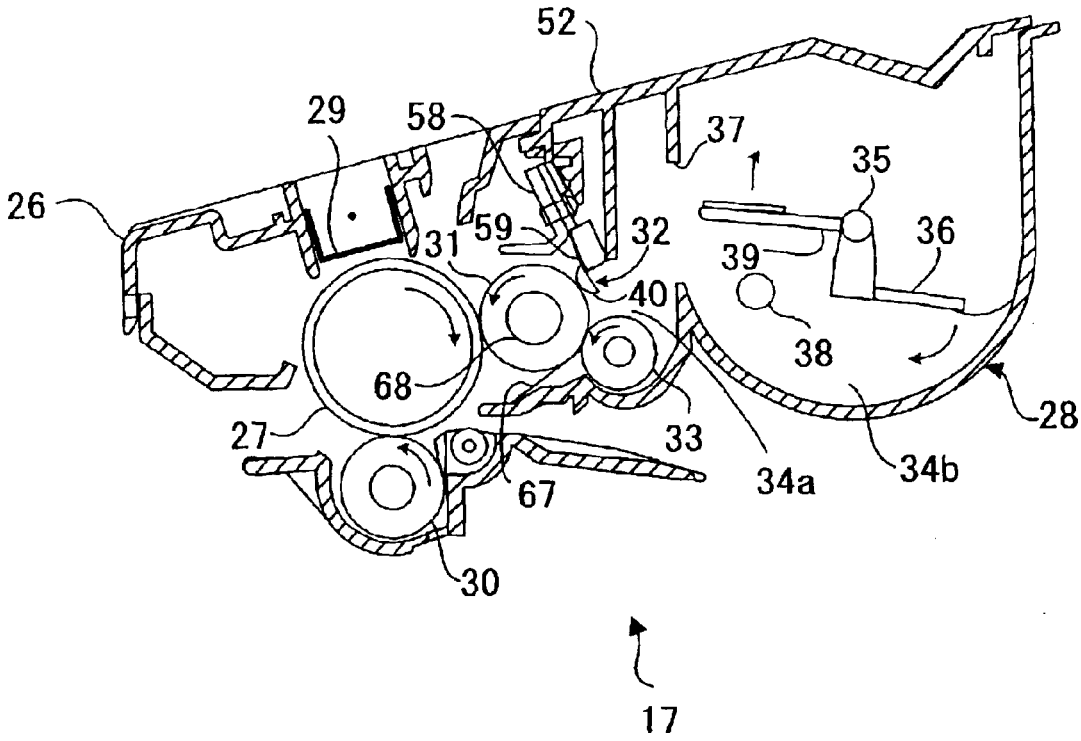
FIG. 2 is a side sectional view of the principal parts of a process unit of the laser printer shown in FIG. 1.

FIG. 2 is an enlarged sectional view of the process unit 17. As shown in FIG. 1, the process unit 17 is disposed below the scanner unit 16 and has a drum cartridge 26 detachably attached to the casing 2 and a developing cartridge 28 detachably attached to the drum cartridge 26. The drum cartridge 26 includes the photosensitive drum 27, a scorotron charger 29, and a transfer roller 30.

The developing cartridge 28 includes a developing roller 31, a layer thickness-regulating blade 32, a supply roller 33, a developing chamber 34*a*, and a toner box 34*b*, all of which are provided within a housing 52 of the developing cartridge 28.

The toner box 34*b* contains positively charged nonmagnetic single-component toner as a developing agent. The toner used in this embodiment is a polymerized toner obtained through copolymerization of styrene-based monomers, such as styrene, and acryl-based monomers, such as acrylic acid, alkyl (C1–C4) acrylate, or alkyl (C1–C4) methacrylate, using a known polymerization method, such as suspension polymerization. The particle shape of such a polymerized toner is spherical, and thus the polymerized toner has excellent flowability.

A coloring agent, such as carbon black, and wax is added to the polymerized toner. An external additive, such as silica, is also added to the polymerized toner to improve flowability. The particle size of the polymerized toner is approximately 6–10 $\mu$m.

The toner in the toner box 34*b* is stirred by an agitator 36 supported by a rotating shaft 35 provided at a central portion of the toner box 34*b*, and is discharged from a toner supply port 37 opened on one side of the toner box 34*b*, toward the developing chamber 34*a*. A toner detection window 38 is provided on a side wall of the toner box 34*b*. The toner detection window 38 is wiped clean by a cleaner 39 supported by the rotating shaft 35.

The supply roller 33 is disposed diagonally downward from the toner supply port 37 so as to be rotatable in a counterclockwise direction. The developing roller 31 is disposed facing the supply roller 33 so as to also be rotatable in a counterclockwise direction. The supply roller 33 and the developing roller 31 are disposed in contact with each other so that they are press-deformed against each other to an appropriate extent.

Figure 5:
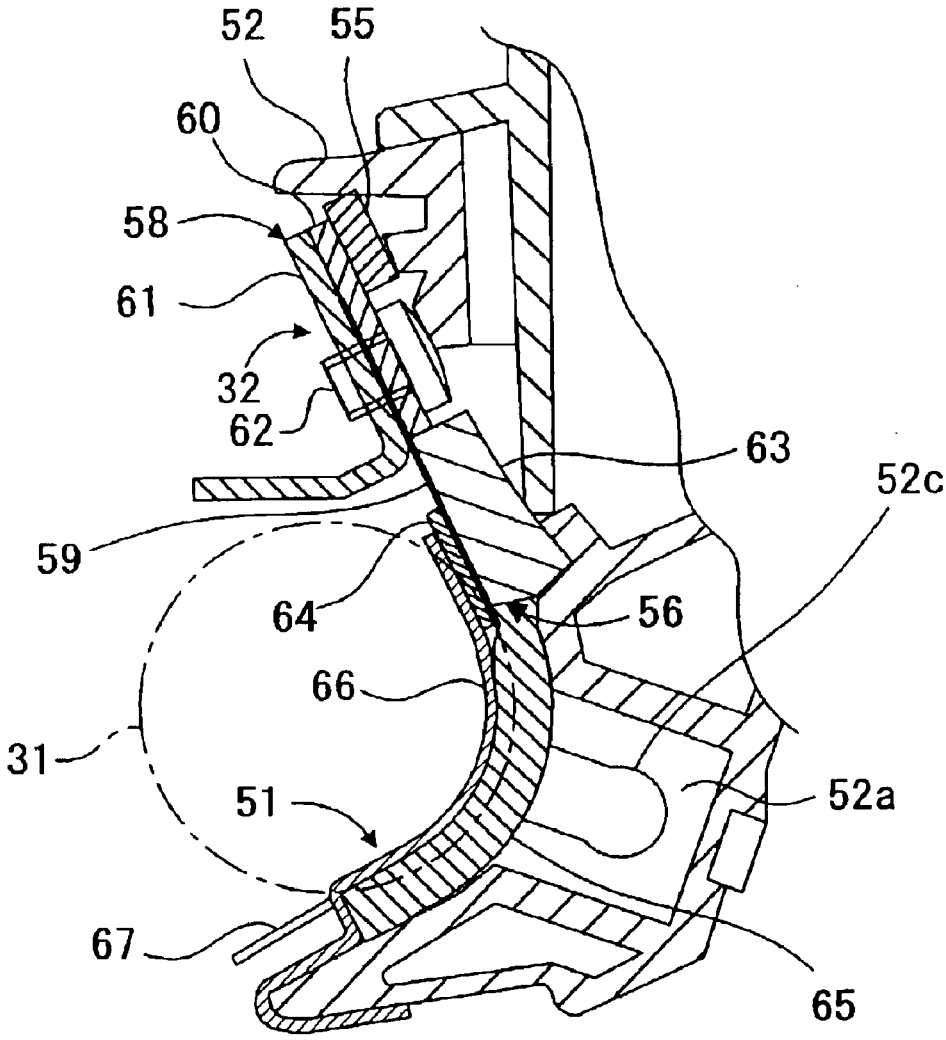
FIG. 5 is a side sectional view of the principal parts of the sealing structure at the end of the cartridge shown with the developing roller not mounted.
Figure 6:
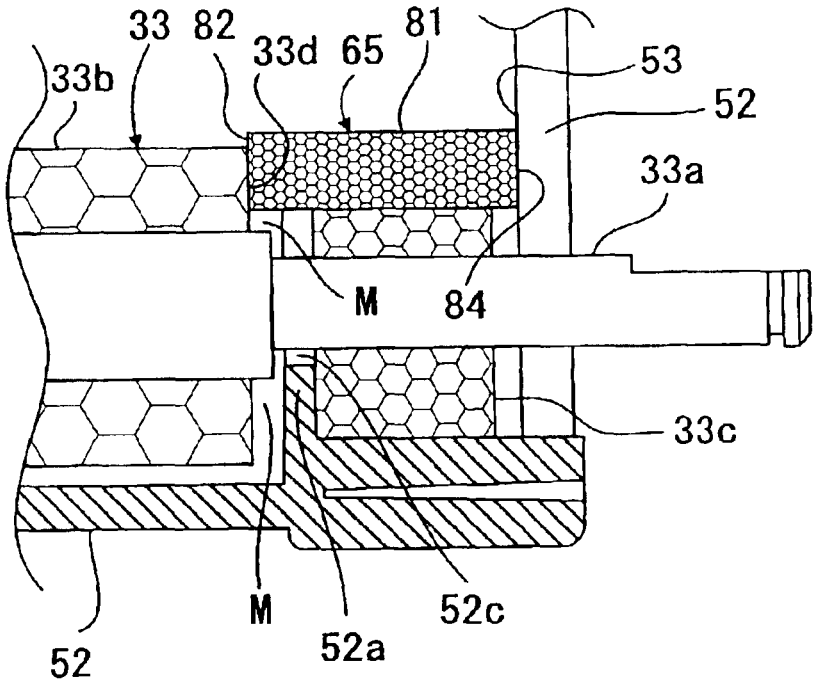
FIG. 6 shows the arrangement of the sponge seal at one end of the supply roller with respect to the axial direction.
Figure 7:
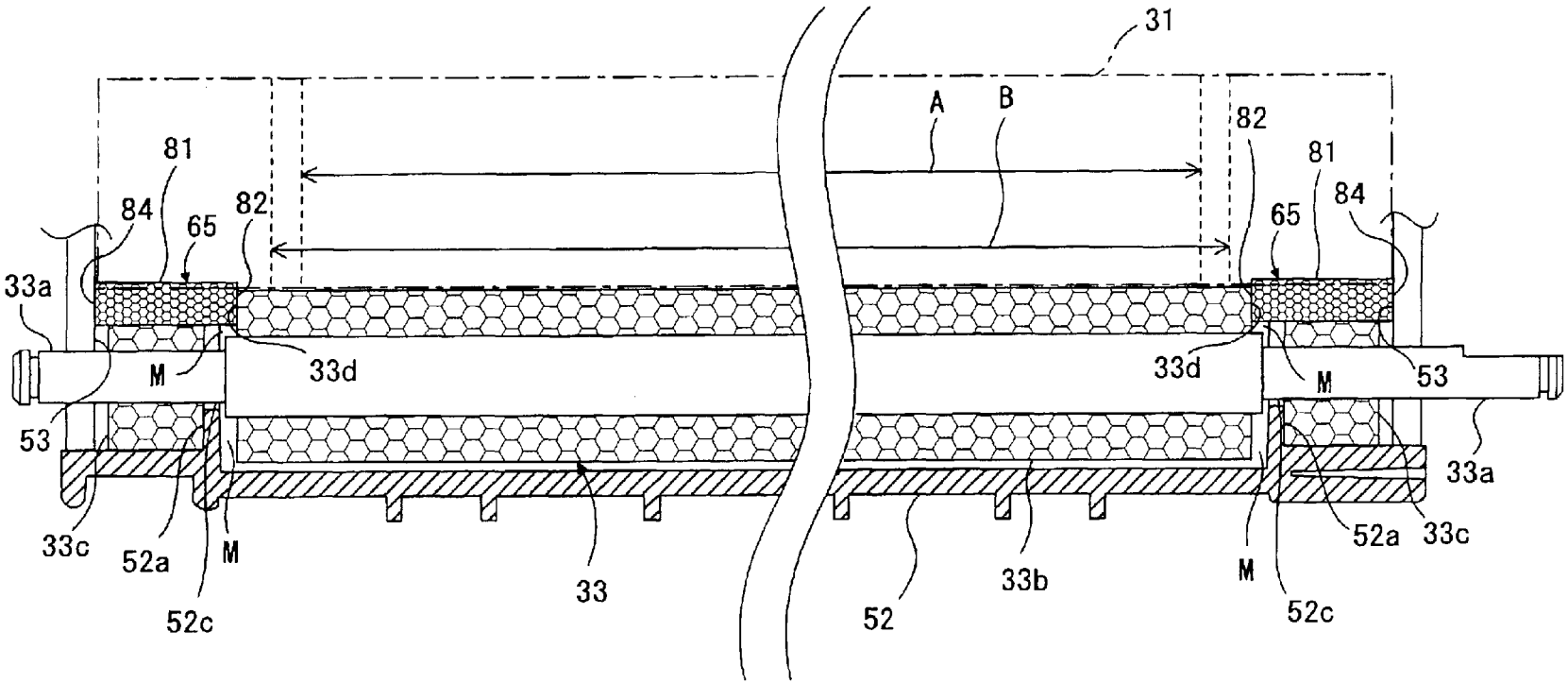
FIG. 7 shows the arrangement of the sponge seal at each of opposite ends of the supply roller of FIG. 6 with respect to the axial direction.

As shown in FIGS. 6 and 7, the supply roller 33 is formed by covering a metallic shaft 33*a* with a conductive sponge material 33*b*. Each of opposite ends of the shaft 33*a* is rotatably supported by a support member 52*a* provided at each of opposite sides of the housing 52 as defined by its width. The support member 52*a* is provided at an inside of a sidewall 53 formed at each of opposite sides of the housing 52 at a specified distance away from the sidewall 53. As shown in FIG. 5, the support member 52*a* is formed with a notch 52*c* to support the shaft 33*a*.

As shown in FIG. 6, an upper part of an end surface 33*d* of the sponge material 33*b*, with respect to the axial direction of the supply roller 31, makes contact with a sponge seal 65 comprising the side seal 51. With this contact, the supply roller 33 is positioned in its axial direction. The structure of the side seal 51 will be described later.

A roller holding member 33*c* made of a sponge is fitted around the shaft 33*a* projecting outside from the support member 52*a* at each end, so as to prevent toner leakage between the support member 52*a* and the sidewall 53.

The developing roller 31 is formed by covering a metallic roller shaft with an electrically conductive rubber material. More specifically, the developing roller 31 is covered with an electrically conductive urethane or silicone rubber containing fine carbon particles, and coated with a urethane or silicone rubber containing fluorine. A predetermined developing bias is applied to the developing roller 31 with respect to the photosensitive drum 27.

Figure 8:
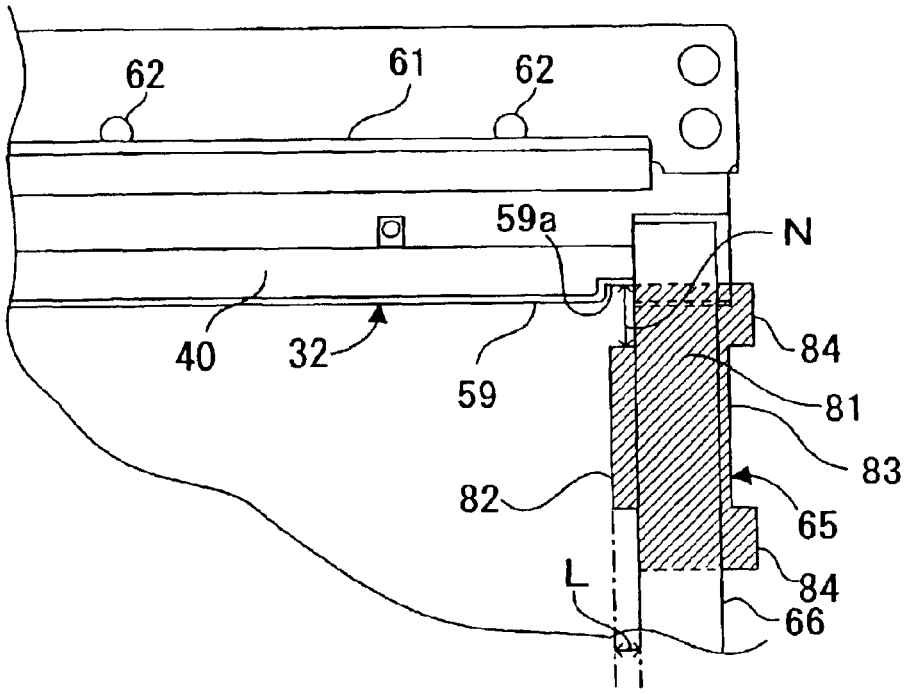
FIG. 8 is a partially cutaway front view showing the principal parts at the end of the cartridge shown in FIG. 4B.

The layer thickness-regulating blade 32 is disposed near the developing roller 31 to regulate the thickness of a toner layer formed on the surface of the developing roller 31. The layer thickness-regulating blade 32 has a metallic plate spring 59 and a presser portion 40. The presser portion 40 is disposed on a distal end of the plate spring 59 and formed from an electrically insulative silicone rubber into a semicircular shape in section. The plate spring 59 is supported to the housing 52, at its end opposite to the distal end of the plate spring 59, by a support member 58 so as to be close to the developing roller 31. The presser portion 40 is pressed against the developing roller 31 by the elastic force of the plate spring 59. Each end of the plate spring 59 is formed with a recess 59*a* as shown in FIG. 8.

The support member 58 comprises a back support member 60 (FIG. 3) formed in a plate extending along the axial direction of the developing roller 31, and a front support member 61, which has an L-shape, in cross section, and is in a face-to-face relationship with the back support member 60. With the plate spring 59 sandwiched between the back support member 60 and the front support member 61, the support member 58 is secured to an upper part of the housing 52 using two screws 62.

Figure 3:
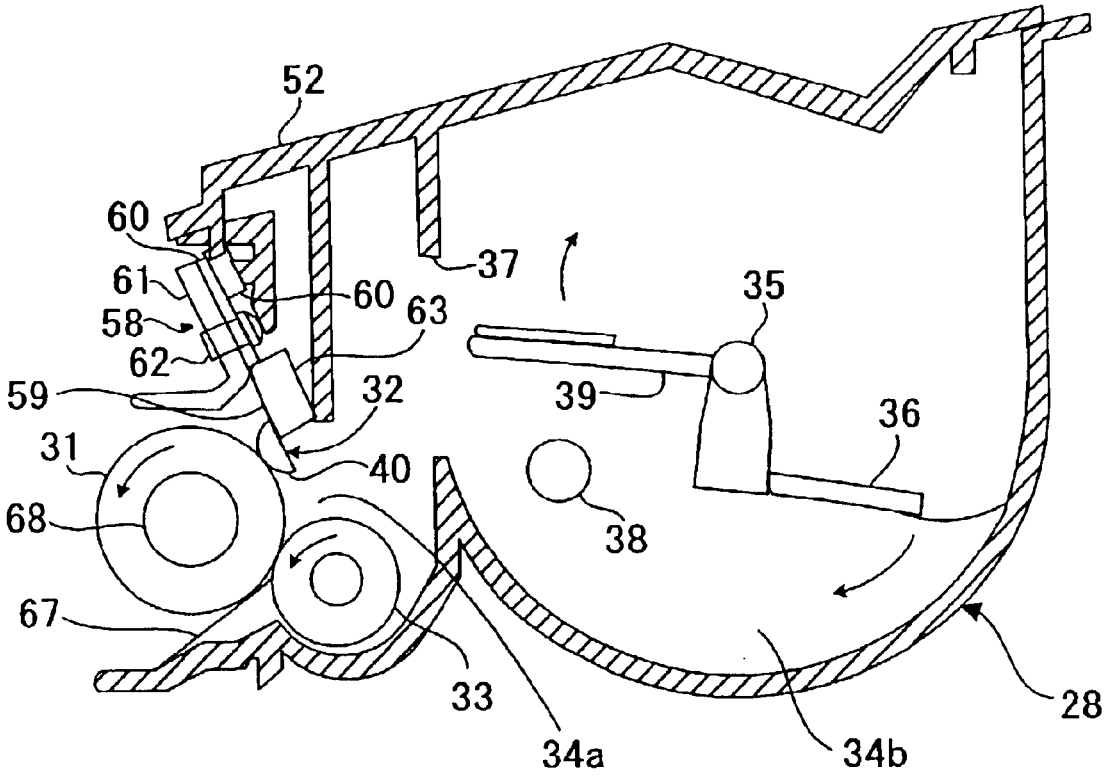
FIG. 3 is a side sectional view of the principal parts of a developing cartridge in the process unit shown in FIG. 2.

As shown in FIGS. 2 and 3, toner discharged by the agitator 36 from the toner supply port 37 to the developing chamber 34*a* is supplied to the developing roller 31 when the supply roller 33 rotates. Toner is positively charged between the supply roller 33 and the developing roller 31 due to friction. Toner supplied to the developing roller 31 passes between the presser portion 40 and the developing roller 31 and is further sufficiently positively (in this embodiment) charged therebetween due to friction. After passing between the presser portion 40 and the developing roller 31, toner is formed into a thin layer of a predetermined thickness on the developing roller 31.

The photosensitive drum 27 is disposed to rotate, in a clockwise direction, in the drum cartridge 26 so as to be in contact with the developing roller 31. The photosensitive drum 27 is formed by coating a grounded cylindrical aluminum drum with a positively charged photosensitive layer made of polycarbonate.

The scorotron charger 29 is disposed at a predetermined distance from the photosensitive drum 27. The scorotron charger 29 produces corona discharge from a tungsten wire and positively charges the surface of the photosensitive drum 27 uniformly.

The transfer roller 30 is disposed below the photosensitive drum 27 and is supported to rotate, in a counter-clockwise direction, by the drum cartridge 26 so as to face the photosensitive drum 27. The transfer roller 30 is formed by covering a metallic roller shaft with an electrically conductive rubber material. A power source (not shown) is electrically connected to the roller shaft such that a predetermined transfer bias is applied to the roller shaft when toner on the photosensitive drum 27 is transferred to the sheet 3.

As shown in FIG. 1, the fixing unit 18 is disposed downstream from the process unit 17 and has a heat roller 41, a pressure roller 42 pressed against the heat roller 41, and a pair of conveying rollers 43 provided downstream from the heat roller 41 and the pressure roller 42. The heat roller 41 is formed by an aluminum tube coated with a silicone rubber and has a halogen lamp placed in the tube. Heat generated from the halogen lamp is transferred to the sheet 3 through the aluminum tube. The pressure roller 42 is made of a silicone rubber, which allows the sheet 3 to be easily removed from the heat roller 41 and the pressure roller 42.

The toner transferred to the sheet 3 by the process unit 17 melts and becomes fixed onto the sheet 3 due to the applied heat, while the sheet 3 passes between the heat roller 41 and the pressure roller 42. After the fixation is complete, the sheet 3 is conveyed downstream by the conveying rollers 43.

An ejecting path 44 is formed downstream from the conveying rollers 43 to reverse the sheet conveying direction and guide the sheet 3 to an output tray 46 provided on the top surface of the laser printer 1. A pair of ejecting rollers 45 is provided at the upper end of the ejecting path 44 to eject the sheet 3 to the output tray 46.

The laser printer 1 is provided with a reverse conveying unit 47 that allows image forming on the both sides of the sheet 3. The reverse conveying unit 47 includes the ejecting rollers 45, a reverse conveying path 48, a flapper 49, and a plurality of pairs of reverse conveying rollers 50.

The pair of ejecting rollers 45 can be switched between forward and reverse rotation. The ejecting rollers 45 rotate forward to eject the sheet 3 to the output tray 46, and rotate in reverse to reverse the sheet conveying direction.

The reverse conveying path 48 is vertically provided to guide the sheet 3 from the ejecting rollers 45 to the reverse conveying rollers 50 disposed above the sheet feed tray 6. The upstream end of the reverse conveying path 48 is located near the ejecting rollers 45, and the downstream end of the reverse conveying path 48 is located near the reverse conveying rollers 50.

The flapper 49 is swingably provided adjacent to a point branching into the ejecting path 44 and the reverse conveying path 48. The flapper 49 can be shifted between a first position shown by solid line and a second position shown by broken line in FIG. 1. The flapper 49 is shifted by switching the excited state of a solenoid (not shown).

When the flapper 49 is at the first position, the sheet 3 guided along the ejecting path 44 is ejected by the ejecting rollers 45 to the output tray 46. When the flapper 49 is at the second position, the sheet 3 is conveyed to the reverse conveying path 48 by the ejecting rollers 45 rotating in reverse.

The plurality of pairs of reverse conveying rollers 50 are provided above the sheet feed tray 6 in a horizontal direction. The pair of reverse conveying rollers 50 on the most upstream side are located near the lower end of the reverse conveying path 48. The pair of reverse conveying rollers 50 on the most downstream side are located below the register rollers 12*a*, 12*b*.

The operation of the reverse conveying unit 47, when an image is formed on the both sides of the sheet 3, will be described. The sheet 3 with a printed image on one side thereof is conveyed by the conveying rollers 43 along the ejecting path 44 toward the ejecting rollers 45. At this time, the flapper 49 is located in the first position. The ejecting rollers 45 rotate forward while pinching the sheet 3 to convey the sheet 3 temporarily toward the output tray 46. The ejecting rollers 45 stop rotating forward when the sheet 3 is almost ejected to the output tray 46 and the trailing edge of the sheet 3 is pinched by the ejecting rollers 45. In this state, the flapper 49 is shifted to the second position, and the ejecting rollers 45 rotate in reverse. The sheet 3 is conveyed in the reverse direction along the reverse conveying path 48. After the entire sheet 3 is conveyed to the reverse conveying path 48, the flapper 49 is returned to the first position.

After the above actions have occurred, the sheet 3 is conveyed to the reverse conveying rollers 50, and conveyed upward by the reverse conveying rollers 50 to the register rollers 12. The sheet 3 is then conveyed to the process unit 17 with its printed side facing down. As a result, an image is printed on both sides of the sheet 3.

The image forming operation will now be described. The surface of the photosensitive drum 27 is uniformly positively charged by the scorotron charger 29. The surface potential of the photosensitive drum 27 is approximately 900 V. When the surface of the photosensitive drum 27 is irradiated with a laser beam emitted from the scanner unit 16, electric charge is removed from the portion exposed by the laser beam, and the surface potential of the exposed portion becomes approximately 200V. In this way, the surface of the photosensitive drum 27 is divided into a high-potential portion (unexposed portion) and a low-potential portion (exposed portion), and thereby an electrostatic latent image is formed. The surface potential of the unexposed portion is approximately 900 V, while the surface potential of the exposed portion is approximately 200 V.

When positively charged toner on the developing roller 31 faces the photosensitive drum 27, the toner is supplied to the low-potential exposed portion of the photosensitive drum 27. As a result, the electric latent image formed on the photosensitive drum 27 becomes visible.

The developing roller 31 reclaims the toner remaining on the surface of the photosensitive drum 27. The remaining toner is the toner that has been supplied to the photosensitive drum 27 but is not transferred by the transfer roller 30 from the photosensitive drum 27 to the sheet 3. The remaining toner adheres to the developing roller 31 by a Coulomb force generated due to a potential difference between the photosensitive drum 27 and the developing roller 31, and is reclaimed into the developing cartridge 28. With this method, a scraper that scrapes the remaining toner from the photosensitive drum 27 and a storage place for the scraped toner are not required. Thus, the laser printer can be simplified in structure and made compact. Further, manufacturing costs are reduced.

While the sheet 3 is passing between the photosensitive drum 27 and the transfer roller 30, the toner forming a visible image on the photosensitive drum 27 is transferred to the sheet 3 by a Coulomb force generated due to a potential difference between the potential of the sheet 3 and the surface potential of the photosensitive drum 27.

The sheet 3 is conveyed to the fixing unit 18 and as described above, the toner on the sheet 3 melts and becomes fixed onto the sheet 3 due to the applied heat. After passing along the ejecting path 44, the sheet 3, on which the toner is fixed, is ejected to the output tray 46.

Side seals 51 are disposed at both ends of the inside of the housing 52 with respect to an axial direction of the developing roller 31. When the developing roller 31 is mounted in position in the developing cartridge 28, the side seals 51 prevent toner carried on the developing roller 31 from leaking from each end of the developing roller 31.

Referring to FIGS. 4A to 9, the sealing structure at each end of the inside of the developing cartridge 28 with respect to the axial direction of the developing roller 31 will be described. FIGS. 4A to 6 and FIG. 8 show structural elements at only one end of the inside of the developing cartridge 28, and the following descriptions are made based on one end of the inside of the developing cartridge 28. The structural elements at the one end are identical to those at the other end.

Figure 4A:
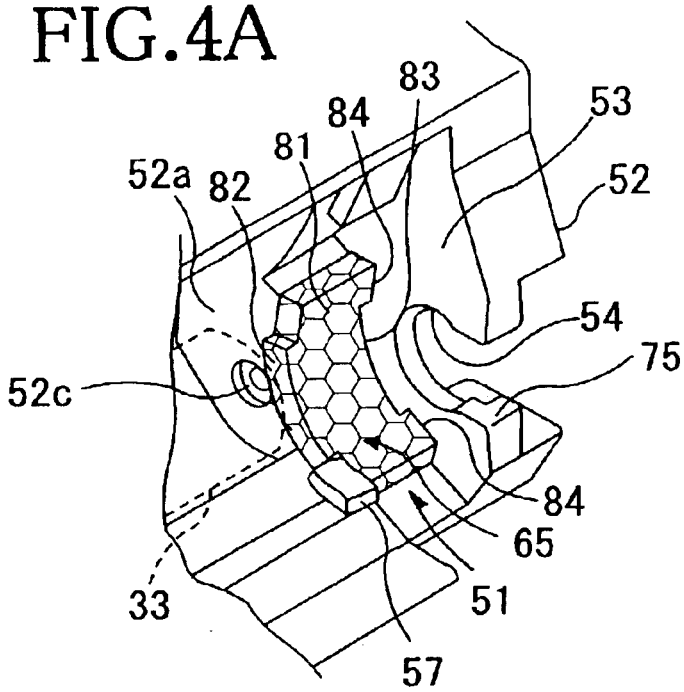
FIG. 4A is a perspective view of the principal parts of a sealing structure at an end of the cartridge shown in FIG. 3 with respect to an axial direction of the developing roller to be mounted in the cartridge, where a sponge seal of a side seal is affixed and the supply roller is detached.
Figure 4B:
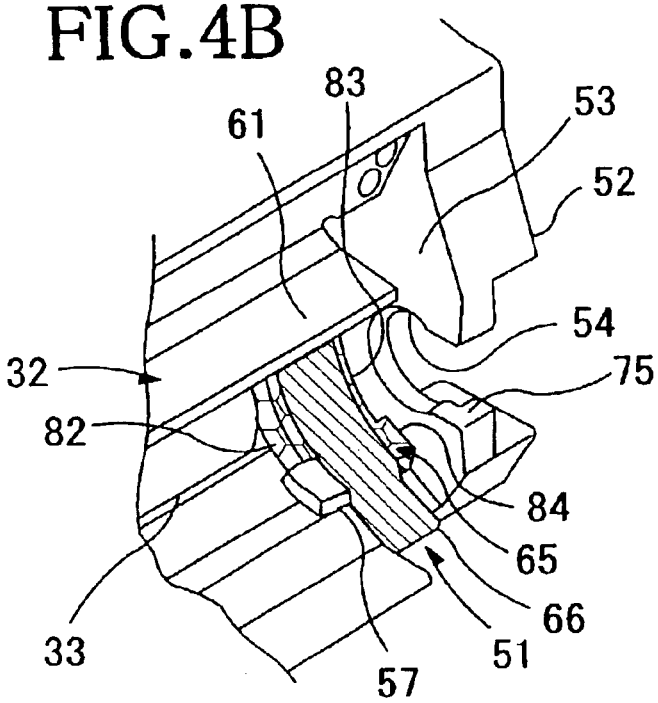
FIG. 4B is a perspective view of the principal parts of the sealing structure at the end of the cartridge, where a sealing element is overlaid on the sponge seal and the supply roller is attached.

As shown in FIGS. 4A and 4B, a housing 52 constituting the developing cartridge 28 is open at a front side. A side wall 53 of the housing 52 is provided with a support hole 54 mounting the developing roller 31 in the housing 52. The side seal 51, an upper side seal 55 (FIG. 5), a blade side seal 56 (FIG. 5), and a lower side seal 57 are provided adjacent to the side wall 53, all of which reliably prevent toner from leaking from each end of the developing roller 31 when mounted in position in the developing cartridge 28. The support hole 54 has an opening 75 at a front side thereof and is formed so as to receive the roller shaft 68 of the developing roller 31 along the opening 75.

The upper side seal 55 is made of a sponge material (e.g. urethane) formed in a substantially rectangular shape having a fixed thickness. As shown in FIG. 5, the upper side seal 55 is disposed facing the support member 58, at an upper portion of the side of the housing 52, and is affixed to the housing 52 with double-faced adhesive tape. Provision of the upper side seal 55 can improve the adhesion of the blade side seal 56.

The blade side seal 56 is provided, at both ends of the layer thickness-regulating blade 32, facing the upper side seal 55 at an end of the plate spring 59 of the layer thickness-regulating blade 32. The blade side seal 56 is made up of a back blade seal 63 provided on a rear surface of the plate spring 59 and a front blade seal 64 provided on a front surface of the plate spring 59.

The back blade seal 63 is made of a sponge material (e.g. urethane) formed in a substantially rectangular shape having a fixed thickness. The back blade seal 63 is affixed to the rear surface of the plate spring 59 facing the upper side seal 55, with double-faced adhesive tape. The back blade seal 63 and the upper side seal 55 are made of sponge material and make contact with each other, thereby preventing the toner from leaking from the upper part of each end of developing roller 31 when mounted in position. The gap shown in FIG. 5 is only due to the cross section being shown at the screw 62 and does not occur elsewhere.

The front blade seal 64 is made of a sponge material (e.g. urethane) formed in a substantially rectangular shape having a fixed thickness, and is affixed to the plate spring 59, on an opposite side to that of the back blade seal 63, with double-faced adhesive tape.

As shown in FIGS. 4A and 4B, the lower side seal 57 is made of a sponge material (e.g. urethane) formed in a substantially rectangular shape having a fixed thickness, disposed adjacent to an inner side of the side seal 51, and affixed to a lower part of the housing 52 with double-faced adhesive tape. Provision of the lower side seal 57 can prevent the toner from leaking from a boundary between the side seal 51 and a lower film 67 shown in FIG. 3.

The side seal 51 is provided adjacent to the side wall 53 of the housing 52 so as to make sliding contact with a circumferential surface of the developing roller 31. The side seal 51 is comprised of a sponge seal 65, and a sealing element 66 overlaid on the sponge seal 65.

The sponge seal 65, providing an urging force, is made of an elastic foamed material, i.e., a sponge material, such as urethane. More specifically, it is made of a high density, microcellular urethane foam (trade name: PORON, manufactured by Rogers Inoac Corporation), which has a comparatively great rigidity and resists permanent deformation among various sponge materials. Its hardness is 0.001 to 0.05 MPa (Mega-Pascal) under 25% compressive load, and preferably 0.005 to 0.025 MPa. The sponge seal 65 is formed in a substantially rectangular shape having a certain thickness to generate a fixed pressing force when compressed by the developing roller 31 mounted in position.

The sponge seal 65 includes a base portion 81 and a projecting portion 82 which are formed integrally as shown in FIGS. 4A, 4B, 6 and 8. The base portion 81 is formed in a substantially rectangular shape, and the top surface thereof is used as a surface to affix the sealing element 66. The projecting portion 82 is formed in a rectangular shape projecting from a center of the base portion 81, with respect to a rotational direction of the developing roller 31, toward the center of the developing roller 31 along its axial direction.

The base portion 81 is provided with a rectangular recess 83 on the side of the base portion 81 opposite the projecting portion 82. The sponge seal 65 is disposed in such a manner that an end portion 84 on the same side of the sponge seal 65 as the recess 83 makes contact with the sidewall 53 of the housing 52, thereby positioning the sponge seal 65 with respect to the width of the housing 52.

The sponge seal 65 is affixed to the housing with double-faced adhesive tape with an upper end of the sponge seal 65 pressed against the back blade seal 63 and the front blade seal 64 as shown in FIG. 5; and a lower end of the sponge seal 65 and the lower side seal 57 slightly overlapping each other in the width direction of the housing 52 as shown in FIG. 4A.

The sponge seal 65, the back blade seal 63, and the front blade seal 64, are all made of sponge materials. With this structure, when the upper end of the sponge seal 65 is pressed against the back blade seal 63 and the front blade seal 64, the sponge materials make contact with each other to reliably prevent toner leakage in the boundary between the sponge seal 65, the back blade seal 63, and the front blade seal 64.

By making the lower end of the sponge seal 65 and the lower side seal 57 slightly overlap each other, the sponge materials make contact with each other, thereby preventing toner leakage in the boundary between the sponge seal 65 and the lower side seal 57.

The sealing element 66 is formed into a substantially rectangular-shaped flat sheet having flexibility, and is made of a textile of cashmere-base fibers. As shown in FIG. 4B, the sealing element 66 is overlaid on the sponge seal 65, adjacent to the sidewall 53 at a side of the housing 52. As shown in FIG. 5, the sealing element 66 covers the front blade seal 64 at an upper end thereof, covers the sponge seal 65 at a lower end thereof, further extends downwardly from the sponge seal 65, and rolls up the lower end of the housing 52. The sealing element 66 is affixed with double-faced adhesive tape.

As the upper end of the sealing element 66 covers the front blade seal 64, toner can be reliably prevented from laterally leaking from the presser portion 40 of the layer thickness-regulating blade 32. As the sealing element 66 moves in accordance with the plate spring 59 of the layer thickness-regulating blade 32, the movement of the plate spring 59 is not limited, and the presser portion 40 is normally pressed against the developing roller 31 under a preferable condition. Thus, the layer of toner formed on the developing roller 31 is made uniform.

The front blade seal 64 interposed between the sealing element 66 and the plate spring 59 can be adequately compressed because it is made of sponge material. The front blade seal 64 can effectively absorb a reactive force of a pressing force between the sealing element 66 and the developing roller 31, thereby reliably obtaining toner sealability between the sealing element 66 and the developing roller 31.

The sealing element 66 is placed over the front blade seal 64. When the front blade seal 64 and the sealing element 66 are layered, they are compressed to an extent that a total thickness of them becomes thicker than the thickness of the presser portion 40 of the layer thickness-regulating blade 32. With this structure, toner can be prevented from laterally leaking from between the presser portion 40 and the developing roller 31, even if the presser portion 40 is worn by friction with the developing roller 31.

The end of the housing 52 where the side seal 51 is provided is formed in a curved shape along the circumferential surface of the developing roller 31 so as to bring the side seal 51 into contact with the developing roller 31. The sponge seal 65 and the sealing element 66 are layered along the curved shape, thus, the sealing element 66 is curved along the circumferential surface of the developing roller 31.

The developing roller 31 is rotatably mounted in the housing 52 by inserting the roller shaft 68 of the developing roller 31 along and into the support hole 54 from the front face where the housing 52 is open, as shown in FIG. 4B. Thus, the developing roller 31 can rotate in a state that the circumferential surface of the developing roller 31 makes sliding contact with the sealing elements 66 at the ends of the developing roller 31.

While the developing roller 31 rotates, toner does not leak from between the developing roller 31 and the sealing element 66 at each end of the developing roller 31, thereby ensuring sufficient toner sealability.

The lower film 67 is made of a polyethylene terephthalate (PET) sheet or an urethane rubber film, and affixed, with double-faced adhesive tape, entirely to a top face of the lower part of the housing 52, as shown in FIGS. 2 and 3. The lower film 67 prevents toner from leaking from the lower part of the housing 52.

As described above, the sponge seal 65 is provided with the base portion 81 and the projecting portion 82, which are integrally formed, and the base portion 81 includes the recess 83. As shown in FIG. 4A, the projecting portion 82 projects from the center of the base portion 81 toward the developing roller 31, and the recess 83 is formed on the side of the base portion 81 opposite the projecting portion 82 so as to be engageable with the projecting portion 82 of another sponge seal 65. The sponge seal 65 is symmetrical with respect to its center with respect to the rotational direction of the developing roller 31.

A length indicated by L in FIG. 8, where the projecting portion 82 projects in the axial direction of the developing roller 31, is in the range of 0.5 to 2.5 mm. When the length L is less than 0.5 mm, the sealing element 66 may deviate from the projecting portion 82 because of tolerance or a margin of error of the installed position of the sealing element 66. Consequently, the sealing element 66 may be bent in contact with the end surface 33*d* of the supply roller 33, causing toner leakage.

On the other hand, when the length L exceeds 2.5 mm, the projecting portion 82 may be deformed, causing toner leakage. Further, if the projecting portion 82 overlaps a first region A (FIG. 7) of the developing roller 31, corresponding to a region where a latent image is formed on the photosensitive drum 27, or a second region B (FIG. 7) of the developing roller 31, corresponding to a maximum width of the sheet 3, the toner held on the developing roller 31 may come into contact with the projecting portion 82, which may cause improper image formation, such as streaks at a side of the sheet 3.

In the above embodiment, the length L for which the projecting portion 82 of the sponge seal 65 projects is in the range of 0.5 to 2.5 mm, and the projecting portion 82 does not overlap the first region A nor the second region B. Therefore, toner leakage is prevented and a proper image is formed.

The sponge seal 65 is affixed to a curved portion of the top of the housing 52 with double-faced adhesive tape so that the projecting portion 82 makes contact with the upper part of the end surface 33*d* of the supply roller 33, as shown in FIG. 7, when the end portion 84 is positioned at the sidewall 53 of the housing 52.

When the sponge seal 65 is affixed to the housing 52, the base portion 81 and the projecting portion 82 are curved as shown in FIG. 4A. As shown in FIG. 8, the upper end of the projecting portion 82 faces the recess 59*a* of the plate spring 59 with a predetermined space N. Toner, which is dispersed in the axial direction by the rotation of the supply roller 33 to make contact with the projecting portion 82, is moved to the space N, and the side seal 51 blocks the flow of toner outside the housing 52.

When the sponge seal 65 is affixed to the housing 52, the projecting portion 82 projects toward the center of the supply roller 33 further than the position of the support member 52*a* of the housing 52 as shown in FIG. 6. As shown in FIG. 7, the upper part of the end surface 33*d* at each end of the supply roller 33 makes contact with the projecting portion 82, thereby positioning the supply roller 33. As a result, a space M is provided between the end surface 33*d* of the supply roller 33 and the support member 52*a* at each side. Toner, which disperses in the axial direction due to rotation of the supply roller 33 and makes contact with the inner edge of the projecting portion 82, is moved to the space M, and the side seal 51 blocks the flow of toner outside of the housing 52.

The spaces M, N prevent toner from building up at the projecting portion 82. If toner builds up at the projecting portion 82, the toner sealability may deteriorate. However, in the embodiment, the toner sealability is maintained and proper image formation is obtained.

If the sealing element 66 affixed to the sponge seal 65 deviates from the sponge seal 65 toward the inside of the developing roller 31 with respect to the axial direction, toner in the developing chamber 34*a* does not directly come into contact with the sealing element 66 because the sealing element 66 is supported by the projecting portion 82. Therefore, even if the printer 1 is used for a long term, toner leakage can be prevented.

As shown in FIG. 7, the end surface 33*d* of the supply roller 33 makes contact with the inner edge of the projecting portion 82 at each end, so that the developing roller 31 makes contact with the top end of the projecting portion 82. In other words, the projecting portion 82 is not pinched between the supply roller 33 and the developing roller 31. As a result, the circumferential surface of the supply roller 33 does not slide between the projecting portion 82 and the sealing element 66.

With the structure disclosed in U.S. Pat. No. 6,336,014, the sponge of the supply roller 33 is apt to become gouged or damaged. However, according to the above described structure, the supply roller 33 is seldom damaged so there is no worry that sponge chips can get into the toner, and thus the proper images are formed.

In the developing cartridge 28 of the embodiment, the upper part of the end surface 33*d* of the supply roller 33 makes contact with the inner edge of the projecting portion 82. In other words, there is no space between the supply roller 33 and the projecting portion 82 with respect to the axial direction of the supply roller 33. This allows the supply roller 33 to supply toner in the developing chamber 34*a* to the developing roller 31, thereby circulating toner in the developing chamber 34*a* in a good condition. By rotation of the developing roller 31, toner is dispersed in the axial direction of the developing roller 31 between the side seal 51 and the developing roller 31.

The sponge seal 65 is affixed to the curved portion of the housing 52, which is formed concentrically along the circumferential surface of the developing roller 31. That is, the projecting portion 82 also becomes curved, so that the side seal 51 and the circumferential surface of the developing roller 31 are pressed against each other to an appropriate extent. As a result, toner can be reliably prevented from making contact with the sealing member 66, and the toner sealability can be maintained.

The sponge seal 65 is symmetrical about its center with respect to the rotational direction of the developing roller 31, so that it can be attached at either end of the developing roller 31. Therefore, commonality of parts reduce the manufacturing costs and simplify the assembly operation.

Figure 9:
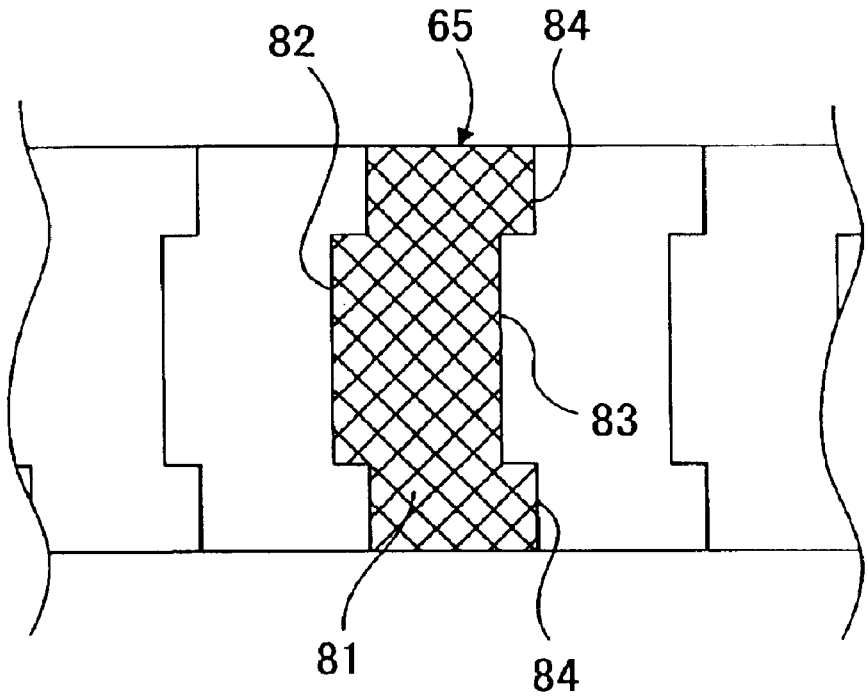
FIG. 9 shows formation of the sponge seal, shown in FIGS. 4A and 4B, by stamping.

The sponge seal 65 has the recess 83, in which the projecting portion 82 of another sponge seal 65 is engageable, on the side of the base portion 81 opposite the projecting portion 82. As shown in FIG. 9, the sponge seal 65 can be produced from long lengths of a foam elastic member by stamping without loss of material. The ease with which the sponge seal 65 can be formed increases yield and reduces costs.

As shown in FIGS. 4A and 4B, in the sponge seal 65, the end portions 84, which are on the same side as the recess 83, function as a positioning mark for attaching the sponge seal 65 to the housing 52. That is, the end portions 84 of the sponge seal 65 formed by stamping are used as the positioning marks as they are, which simplifies the structure and reduces costs.

The sponge seal 65 is made of urethane which is an elastic foam material having a hardness of 0.001 to 0.05 MPa under 25% compression load, and resists permanent deformation. Thus, even if the printer 1 is used for a long term, and the sponge seal 65 is kept pressed against the developing roller 31 in tight contact, toner sealability is maintained.

The printer 1 uses polymerized toner. Polymerized toner is adequate to obtain images of high resolution because it has a uniform particle size. Conversely, it is prone to leak from the side seal 51 by the rotation of the developing roller 31 because of high flowability. However, toner leakage can be reliably prevented with the use of the sponge seal 65 structured above. Therefore, the laser printer 1 includes the developing cartridge 28 that can seal toner for a long time, so that toner can be prevented from dispersing in the casing 2, and the printer 1 can reliably function.

In the above embodiment, the sealing element 66 is made of cashmere-base textile fabric, however, it may be a felt, knit, hair implant, nonwoven material, or other media as long as it is made of cashmere-base fibers or polyester-base fibers. Several examples of the sealing element 66 are disclosed in U.S. patent application Ser. No. 10/106,238, the disclosure of which is incorporated by reference herein in its entity.

While the invention has been described in detail and with reference to the specific embodiments thereof, it would be apparent to those skilled in the art that various changes, arrangements and modifications may be applied therein without departing from the spirit and scope of the invention.

What is claimed is:

1. A developing cartridge, comprising:

a housing that accommodates developer therein;

a supply roller, rotatably supported in the housing, that supplies the developer;

a developing roller, rotatably supported in the housing, that holds the developer thereon supplied by the supply roller; and a side seal provided at both lengthwise ends of the developing roller, wherein the side seal further comprises:

a sealing element making a sliding contact with a circumferential surface of the developing roller, and a seal member including a base portion and a projecting portion projecting from the base portion toward an end of the supply roller, the sealing element being provided on the base portion, the projecting portion facing the circumferential surface of the developing roller.

2. The developing cartridge according to claim 1, the seal member is provided such that a space is formed between a lengthwise end of the supply roller and the housing.

3. The developing cartridge according to claim 1, further comprising a regulating member that contacts the circumferential surface of the developing roller to regulate a thickness of the developer held on the developing roller, wherein the seal member is provided such that a space is formed between the projecting portion and the regulating member in a rotational direction of the developing roller.

4. The developing cartridge according to claim 3, wherein the seal member is symmetrical with reference to a center thereof in the rotational direction of the developing roller.

5. The developing cartridge according to claim 4, wherein the seal member has a recess portion opposite to the projecting portion, the recess portion being engagable with the projecting portion of another seal member.

6. The developing cartridge according to claim 5, wherein an end portion on the recess portion side of the seal member contacts a side of the housing.

7. The developing cartridge according to claim 1, wherein the seal member is made of an elastic foamed material.

8. The developing cartridge according to claim 7, wherein the seal member is made of urethane.

9. The developing cartridge according to claim 8, wherein the seal member has a hardness of 0.001 to 0.05 MPa under 25% compression load.

10. The developing cartridge according to claim 1, wherein the developer is copolymerized toner.

11. The developing cartridge according to claim 1, wherein the base portion and the projecting portion are formed integrally.

12. The developing cartridge according to claim 11, wherein the base portion is provided at a curved portion of the housing along the circumferential surface of the developing roller so that the sealing element is curved.

13. The developing cartridge according to claim 1, wherein the projecting portion faces the end of the supply roller.

14. The developing cartridge according to claim 13, wherein at least part of the end of the supply roller contacts the projecting portion.

15. The developing cartridge according to claim 14, wherein the projecting portion is formed with projecting length of 0.5 mm to 2.5 mm.

16. The developing cartridge according to claim 14, wherein the projecting portion is formed with projecting length so as not to overlap a first region of the developing roller, the first region corresponding to a region on an image holding member capable of forming an image.

17. The developing cartridge according to claim 16, wherein the projecting portion is formed with projecting length so as not to overlap a second region of the developing roller, the second region corresponding to a maximum width of a recording medium on which the image is transferred from the image holding member.

18. A developing cartridge, comprising:

a housing having opposing sides;

a developing roller rotatably mounted via a shaft between the opposing sides;

a supply roller rotatably mounted between the opposing sides, wherein each opposing side has an opening for receiving the shaft of the developing roller and a recessed area complementary to a portion of an outer circumference of the developing roller; and a seal unit comprising:

a compressible member mounted to the recessed area; and a seal member overlying at least a central portion, in an axial direction of the developing roller, of the compressible member, wherein an end of the developing roller is pressed by the seal member, and the compressible member has a rectangular center portion with a central projection extending from a center of one longitudinal side of the center portion, the central projection projecting toward an end of the supply roller.

19. The developing cartridge according to claim 18, wherein the compressible member has an end projection extending from each end of the other longitudinal side of the center portion.

20. The developing cartridge according to claim 18, wherein the compressible member has a hardness of 0.001 to 0.05 MPa under 25% compression load.

21. The developing cartridge according to claim 18, wherein the central projection projects 0.5 mm to 2.5 mm.

22. The developing cartridge according to claim 18, wherein the central projection faces the end of the supply roller.

23. The developing cartridge according to claim 22, wherein the central projection contacts an end surface of the supply roller.

24. The developing cartridge according to claim 18, wherein the seal member overlies the rectangular center portion of the compressible member.

25. A developing cartridge, comprising:

a housing that accommodates developer therein;

a supply roller, rotatably supported in the housing, that holds the developer thereon supplied by the supply roller; and a side seal provided at both lengthwise ends of the developing roller, wherein the side seal further comprises:

a sealing element making a sliding contact with a circumferential surface of the developing roller, and a seal member including a base portion, that supports the sealing element thereon, and a projecting portion from the base portion toward an end of the supply roller, wherein the projecting portion is formed with projecting length of 0.5 mm to 2.5 mm.

* * * * *